US010495420B2

(12) United States Patent
Blache et al.

(10) Patent No.: US 10,495,420 B2
(45) Date of Patent: Dec. 3, 2019

(54) SYSTEM FOR DEFENSE AGAINST THREATS

(71) Applicant: RHEINMETALL WAFFE MUNITION GmbH, Unterluess (DE)

(72) Inventors: Andreas Blache, Loerrach (DE); Steffen Speer, Schutterwald (DE); Frank Heymann, Oberndorf (DE); Christian Kniep, Dietingen (DE); Heiko Sand, Geislingen (DE); Hubert Schneider, Dietingen (DE)

(73) Assignee: RHEINMETALL WAFFE MUNITION GmbH, Unterluess (DE)

( * ) Notice: Subject to any disclaimer, the term of this patent is extended or adjusted under 35 U.S.C. 154(b) by 0 days.

(21) Appl. No.: 15/906,330

(22) Filed: Feb. 27, 2018

(65) Prior Publication Data

US 2018/0238661 A1 Aug. 23, 2018

Related U.S. Application Data

(63) Continuation of application No. PCT/EP2016/069939, filed on Aug. 24, 2016.

(30) Foreign Application Priority Data

Aug. 27, 2015 (DE) ..... 10 2015 011 058

(51) Int. Cl.
*F41H 11/02* (2006.01)
*F41A 9/35* (2006.01)
(Continued)

(52) U.S. Cl.
CPC ..... *F41H 11/02* (2013.01); *F41A 9/35* (2013.01); *F41H 13/0043* (2013.01); *F42B 5/313* (2013.01); *G01S 5/02* (2013.01)

(58) Field of Classification Search
CPC .. F41H 11/02; F41A 9/35; F42B 5/313; G01S 5/02
(Continued)

(56) References Cited

U.S. PATENT DOCUMENTS 6,659,012 B1 12/2003 Grassl et al.
7,205,520 B1 * 4/2007 Busse ..... F41H 11/02 250/203.6
(Continued)

FOREIGN PATENT DOCUMENTS

DE 10 2005 038 071 A1 2/2007
DE 10 2005 054 275 A1 5/2007
(Continued)

*Primary Examiner* — Samir Abdosh
(74) *Attorney, Agent, or Firm* — Muncy, Geissler, Olds & Lowe, P.C.

(57) ABSTRACT

A protection and defence system for an infrastructure against a threat approaching the infrastructure, comprising at least one effector. When a threat is determined, the at least one effector dispenses a non-lethal countermeasure which damages the threat and thus causes its crash. Vision and target tracker, such as at least a camera and tracker, and at least one directing/actuating drive are allocated to the effector or effectors. The effector and the vision and target tracker thereof are supported by a modular platform which can be fixedly installed to/on various infrastructures, can be removed therefrom and be used in a mobile mode. In addition, the platforms comprise a sensor that detects the spatial position of the effectors.

11 Claims, 1 Drawing Sheet

(51) Int. Cl.
*F41H 13/00* (2006.01)
*F42B 5/313* (2006.01)
*G01S 5/02* (2010.01)

(58) Field of Classification Search
USPC ..... 89/37.02
See application file for complete search history.

(56) References Cited

U.S. PATENT DOCUMENTS 7,886,646 B2 * 2/2011 Bannasch ..... F41H 3/00 89/1.11
8,463,518 B2 6/2013 Priller et al.
8,596,178 B2 * 12/2013 Rogers ..... F41H 13/0006 102/502
2003/0117309 A1 6/2003 Pappert et al.
2007/0180983 A1 * 8/2007 Farinella ..... F41H 5/026 89/36.07
2008/0208514 A1 * 8/2008 Weber ..... F41H 11/02 702/134
2009/0158954 A1 6/2009 Wardecki et al.
2009/0173822 A1 * 7/2009 Kravitz ..... B64D 7/00 244/1 R
2009/0224958 A1 * 9/2009 Aphek ..... F41G 7/224 342/54
2010/0070238 A1 * 3/2010 Phelps ..... F41G 3/02 702/181
2012/0222545 A1 9/2012 Niv
2014/0216290 A1 * 8/2014 Yee ..... F41H 11/02 102/374
2014/0251123 A1 * 9/2014 Venema ..... F41G 3/16 89/41.22
2015/0293212 A1 * 10/2015 Moraites ..... G01S 5/00 250/492.1
2017/0059692 A1 * 3/2017 Laufer ..... G01S 7/38
2017/0192089 A1 * 7/2017 Parker ..... G01S 3/782
2017/0261604 A1 * 9/2017 Van Voorst ..... G01S 7/51

FOREIGN PATENT DOCUMENTS

DE 10 2010 017 867 A1 11/2010
DE 10 2011 111 201 B3 1/2013
EP 1035401 B1 2/2005
EP 1668310 B1 5/2011
WO WO 01/06197 A1 1/2001
WO WO 01/88564 A1 11/2001

* cited by examiner

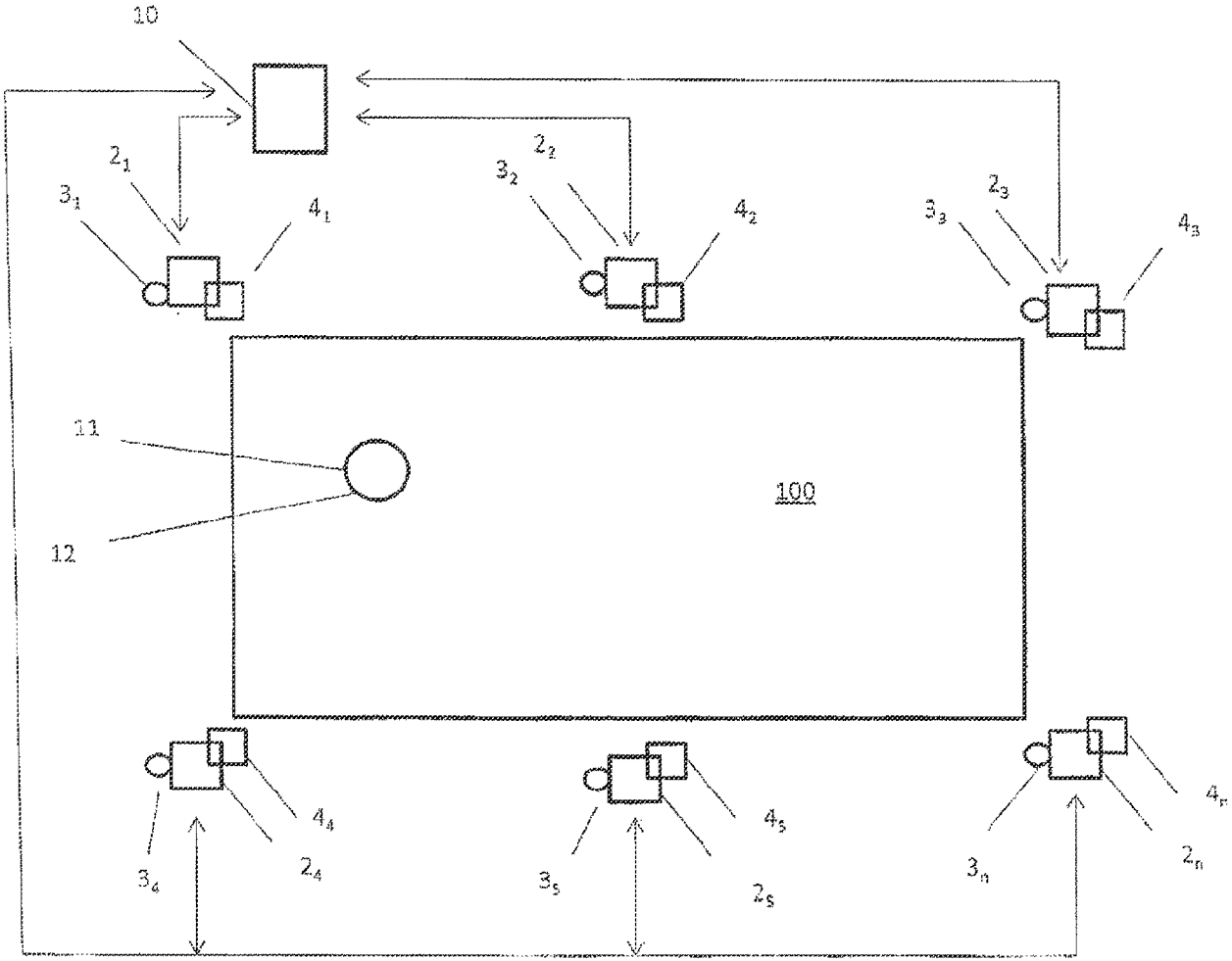
10
$4_1$
$2_1$
$3_1$
$4_2$
$2_2$
$3_2$
$4_3$
$2_3$
$3_3$
11
12
100
$4_4$
$2_4$
$3_4$
$4_5$
$2_5$
$3_5$
$4_n$
$2_n$
$3_n$

SYSTEM FOR DEFENSE AGAINST THREATS

This nonprovisional application is a continuation of International Application No. PCT/EP2016/069939, which was filed on Aug. 24, 2016, and which claims priority to German Patent Application No. 10 2015 011 058.6, which was filed in Germany on Aug. 27, 2015, and which are both herein incorporated by reference.

BACKGROUND OF THE INVENTION

Field of the Invention

The present invention relates to a system for the prevention of threats, especially against drones or other unwelcome light missiles. According to the invention, upon detecting a threat and the intrusion of the same into a specified protected area, this threat is averted by a preferably non-lethal countermeasure and is at least brought to crash. Such threats generally have a flat hull. This allows them to be crashed by a plurality of projectiles fired at the same time or slightly staggered in time. In order to ensure that the measure is non-lethal, the projectiles that have not come into contact with the threat should have used up their energy by the time they hit the ground.

Description of the Background Art

Because of the rapid progress in electronics, systems such as Quadrocopter (drone, also with camera), Octocopter, etc. are not only used for military applications but also by the civilian population. These low-cost drones (gyros) are airborne and can be operated by anyone with more or less experience.

Such drones can thus also be misused and/or pose a threat to others and/or to buildings, etc. An attack and/or spying is especially suspected when such drones appear around campaign events, power plants, prisons, ports, etc., i.e., when the target is sensitive equipment or, in particular, politically motivated gatherings. It is particularly alarming that these models can be flown both day and night. In addition, the drone sensors can provide a stabilized image to the operator of the drone via radio link. These drones can also be operated by the operator/pilot without a direct line of sight. It is also possible to project this image, for example, onto the eyewear of the operator.

Furthermore, the drones are capable of loading payloads of up to 3 kg. These payloads could increase in the future. The drones can also be linked together in swarms and flown as a swarm. The necessary software is freely available and can, for example, be obtained from the internet.

Systems, such as launchers, to protect objects, such as buildings, vehicles, etc., against threats are known from the prior art. Such launchers have been offered by the applicant for years. Thus, from EP 1 668 310 B1, which corresponds to U.S. Pat. No. 7,886,646, which is incorporated herein by reference, a method and an apparatus for protecting ships against terminal guidance missiles are known. A launching device for firing multiple charges is disclosed in EP 1 035 401 B1, which corresponds to U.S. Pat. No. 6,659,012.

From DE 10 2005 054 275 A1, which corresponds to US 2009/0158954, which is incorporated herein by reference, a self-protection system for combat vehicles or other objects to be protected is known, whose object is, even before delivery of a threat, to detect said threat and dispense the appropriate countermeasures, such as fog. The detection is provided by warning sensor technology, such as laser detectors, UV detectors, etc. The self-protection system is embodied by multiple launchers, preferably four, which are electrically assigned to a common fire control system. For monitoring around the clock, a plurality of detectors are used, which are attached to the object or vehicle.

Such protection systems are used to deceive and camouflage, but are unsuitable for the destruction or flight impairment of a threat.

Systems are already known, which prevent, for example, an RF link by jamming. However, a disadvantage is that the jamming can be canceled by countermeasures.

SUMMARY OF THE INVENTION

It is therefore an object of the present invention to provide a secure system which protects against smaller airborne threats such as drones, and which eliminates the threat's ability to remain airborne and goes as far as to destroy the threat.

The essential basic idea of the invention is that the defense against or the shooting down of the threat with non-lethal missiles, projectiles, etc. that act destructively in/on the target (threat) takes place with a 100% probability of destruction of or defense against the threat without lethal effect to the environment. The non-lethal countermeasure includes projectiles that have a kinetic energy $E' \leq 0.1$ J/mm$^2$ upon reaching the maximum firing distance. The firing/combative action always occurs in a way so that projectiles which do not hit the threat reach the maximum flight time so as to reduce the kinetic energy to $E' \leq 0.1$ J/mm$^2$.

The protection system according to the invention comprises at least one effector (weapon, launcher, etc.), but preferably several. Subsequently, the system is described as having several effectors. However, only one effector may also be used. The number of multiple effectors should be chosen depending on the object, the infrastructure or the environment to be protected. Complete 360° protection is thereby reliably ensured.

In an embodiment, effectors are provided which can fire in particular plastic projectiles or other projectiles that are non-lethal to the surrounding area, with a high CW value at a preferably high firing rate and a defined position (orientation). The aim is for the effectors to have a (total) rate of 3000 rounds/min, which are fired against the threat and can act thereupon. The caliber of the ammunition is designed such that only one special type of ammunition such as plastic bullets, etc. can be loaded into the effectors and ammunition with lethal effect cannot be used (inserted).

As the preferred effector, the invention provides a so-called multi-barrel weapon. Multi-barrel weapons have the advantage that the barrels, even at high firing rates, do not undergo the same wear as known weapons with only one barrel. Such weapons are already known under the term "Gatling".

A multi-barrel weapon of a newer type is described in DE 10 2010 017 867 A1, which corresponds to U.S. Pat. No. 8,463,518, and which is incorporated herein by reference. Here, the belt system may be part of the ammunition and may form a chamber together with the latter. The ammunition and the belt feed are transported by a rolling block with stars. Shells of the star produce a partial chambering of the belt elements in the firing position.

DE 10 2011 111 201 B3, which is incorporated herein by reference, refines the idea from DE 10 2010 017 867 A1 and proposes peripheral slots in the stars of the rolling block, providing a cleaner transport of the belt strap or the belt elements. Another related technical advantage is that a multi-feed of identical or different types of ammunition is allowed. This is realized in that the belt guide is connected to the side of the weapon and held on the weapon side such that it can be pulled out of the slot of the other star (barrel) of the rolling block. Also, firing is possible simultaneously, albeit slightly offset in time, from any of the possible shooting positions, thereby increasing the firing rate.

WO 01/06197 A1 also discloses a multi-barrel weapon. By means of two drives, this multi-barrel weapon is supplied with ammunition in rotating ring gear, which are incorporated in cylinders of an ammunition magazine. The ammunition magazine is formed by the cylinder and intermediate webs (chain feed mechanism). If the cylinder and barrel are in alignment, the ammunition is fired.

The non-lethal ammunition with the plastic projectiles (bullets) in turn is provided such that the projectiles that hit the threat, damage said threat in such a way that at a minimum, a crash results. However, projectiles which do not contribute to the defense/crash, systematically reduce their energy on their trajectory to the extent that the single projectile, at a maximum, falls to the ground with the energy of, for example, a hailstone.

A firing distance of about 10 m or 500 m is provided. This area then constitutes the area to be protected or the environment of the object or the infrastructure to be protected, in which the threat is to be combatted. The effectors are setup within the area to be protected such that it is always ensured that in the event that the plastic projectiles cannot hit the threat itself, they can reach a maximum flight range to reduce their energy so as not to damage any infrastructure or people.

The effectors, which, for example, fire the non-lethal plastic projectiles at high rates, have their own sensors (sensor system) such as a separate EO sensor (e.g., day camera and IR camera) and a private tracker. The effectors can be quickly aligned by elevation and azimuth using a separate targeting system. The necessary control signals for the alignment are produced either by a fire control system of a command center, the track data of the effector sensors and/or via a manual control. The effectors with their accessories (sensors, actuators, etc.) are preferably connected via cable to the command center.

As an alternative, lasers can be used as effectors that can destroy the drone. Currently, however, this type of countermeasure is associated with high costs. In addition, the reflection of the laser radiation can be a hazard. Additionally, the effectors may be water cannons that can be directed.

Furthermore, the system comprises at least one sensor which is situated in the area to be protected and on the infrastructure to be protected, and which can preferably continuously scan/search the environment for approaching threats, such as drones. The setup of the at least one reconnaissance sensor for detecting a threat, and of the effectors, is performed such that a detection and defense shell (protective shell) is formed around the infrastructure to be protected.

If one or more threats are detected by the at least one sensor (swarm attack), the data is used to calculate which effector (s) are conducive in order to counter the threat optimally and effectively. These are then, for example, activated by the fire control. The one or more selected effectors then connect by their sensor system (tracker) to the threat (s) (targets) to be averted. The data of the sensor systems is transmitted to the command center. Permission to fire is usually given by an operator. Alternatively, permission can also be provided automatically, in which case security questions should be incorporated into the system.

The indicated level of automation can also be installed in the less automated or semi-automated configuration stage.

The system is designed such that it can be installed in/on different infrastructures but also removed again therefrom. This is called a fixed attachment. Permanent installations, however, are also possible.

It has been found advantageous to provide modular platforms, which serve for receiving the effectors, including target tracking and steering (tracker, actuators). The modular platforms allow for easy and quick installation on an infrastructure. The different types of effectors can also be installed on or inserted in the platform. Each effector is provided with its own platform. Group fixing, i.e., several effectors on the platform, is also conceivable.

Another implementation is the mobile application. The mechanism is the same here. In contrast to the permanent installations, the effectors can be set up quickly, e.g. via tripods or mobile containers, etc. These are equivalent to a modular platform. The mobile platforms with the effectors may also have a sensor that determines their spatial position and transmits said position preferably via cable to a command center with a fire control. Such a sensor can also be used in the permanent version. The mobile application has the appeal that the protective shell may vary, and an up-to-date protective shell can be produced by moving the mobile platforms/effectors.

The power supply of the fixed and the mobile system can be designed to be self-sufficient via, for example, solar, battery, a generator, etc., functioning even during interferences, or to prevent interference from countermeasures.

The system or the individual platforms themselves can be shipped or transported in vehicles by land, sea or air.

Disclosed is a protective and defense system for an infrastructure, against a threat approaching the infrastructure, having at least one effector. Upon detection of a threat, the at least one effector dispenses a non-lethal countermeasure that damages the threat, preferably causing it to crash. Vision and target tracker, such as at least a camera and a tracker, and at least one directing/actuating drive are assigned to the effector or effectors. The effector or effectors and the vision and target tracker thereof are preferably mounted on a common modular platform which can in turn be fixedly installed to/on various infrastructures, can again be removed therefrom and can be used in a mobile mode. The platforms also comprise a sensor that detects the spatial position of the effectors.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which is given by way of illustration only, and thus, is not limitive of the present invention, and wherein the sole figure illustrates an example embodiment, showing a cross-sectional view of an adjustment fitting with a sealing of the eccentric receiving space.

DETAILED DESCRIPTION

The sole figure shows a schematic or outline of an assembly of a protective and defense system 1 according to the invention. Several effectors, here six, are labeled with $2_{1-n}$. In each case at least one camera and one tracker 3 ($3_{1-n}$) are assigned to the effectors 2 for tracking the respective effector 2. For the sake of clarity, the camera and the tracker herein are shown as one unit (=effector sensor system 3) and form a functional unit. However, a functional and spatial separation of the effector sensor system 3 is also possible.

The effectors 2 can be aligned by azimuth and elevation by means of separate directing/actuating drives 4 ($4_{1-n}$). The effectors 2, effector sensor system 3 and directing/actuating drives 4 are preferably each installed on a platform (not shown in detail). They are also electrically connected to a central command center 10 with a fire control. This command center 10 may be located inside or outside of an area 100 to be protected and/or a protective shell (not shown in detail). Preferred is a wired connection, such as a cable connection between the command center 10 and the effectors 2 and their accessories. This can be designed with individual lines and/or bus systems. The effectors 2 with accessories in turn can be attached to or incorporated inside and/or outside of the monitored area 100, for example, of a building, park, etc. Furthermore, at least a monitoring sensor system 11 having at least one sensor 12 is provided, which allows for monitoring of the protected region 100 and the detection of a (the) threat within the protective shell. The protective shell can be identical to, but also greater than, the area to be protected 100. The setup of the sensor or sensors 12 for detecting the threat is then done in such a way that said sensor (s) cover (s) the detection and defense shell (protective shell) around the infrastructure or area to be protected 100 for purposes of monitoring. The effectors 2 are set up such that they can fully sweep the area to be protected 100, at least at its outer limits, with their countermeasure. Two multi-barrel weapons are provided here as effectors 2. These in turn can fire plastic projectiles.

For example, the monitoring electronics 11 (12) detects and tracks at least one approaching, in particular light, missile, for example, a remote controlled drone (not shown in detail). This information is forwarded to the command center 10. There, the threat is checked to see whether a countermeasure is necessary. The test can be performed by an operator and/or automatically, e.g., by measuring the speed at which the threat approaches or recedes.

To introduce the countermeasure, the command center 10 determines, for example, from the spatial position of the effectors 2, which of the effectors $2_{1-n}$ is in a promising position for combatting the approaching threat or threats. The selection can also be made by the operator. The selected effectors 2 are then quickly aligned to the threat (s) by elevation and/or azimuth, by means of their own directing system 4. The fire control system determines the necessary control signals for the alignment and transmits these to the directing/actuating drives 4. Alternatively, the data of the effector sensor system 3 and/or a manual control for the alignment of the selected effectors 2 can be used.

Permission to fire is usually given by an operator. Alternatively, permission can be provided automatically.

The projectiles (not shown in detail) are discharged from the selected and activated effectors 2 in the direction of the threat or threats when these have reached the area to be protected. The plurality of simultaneously fired projectiles acts on the two-dimensional threat (s) and brings about a destruction of the threat (s). The non-lethal projectiles that do not strike the threat or target deplete their energy over the extent of the remaining flight time, and fall to the ground like a hailstone.

For the system 1 to be non-lethal, the mass of the projectile must be considered. To this end, reference is made to the book "Wundballistik von Kurzwaffengeschossen" (Wound Ballistics of Handgun Bullets) (ISBN 978-3-662-10980-9), pages 262 et seq. This book takes a closer look at the depth of penetration and the penetration capability of bullets. The theoretical relationship between the kinetic energy, the impact velocity of the hailstones and the hail diameter has already been studied. The value of E'=0.1 J/mm$^2$ corresponds to a hailstone of 38.5 mm in diameter.

The required as well as ideal mass of the projectile is determined depending on the caliber. It is based on the relationship between the projectile mass and the kinetic energy, which is reflected in the following formula:

$$E' = \frac{m}{2} \times \frac{v^2}{A} \rightarrow v^2 = \frac{2 \times A \times E'}{m},$$

wherein

E' is the average kinetic energy, m is the mass and A represents the caliber of the projectile and v is the steady rate of fall.

This formula can be equated to the formula of the steady rate of fall:

$$v^2 = \frac{2 \times A \times E'}{m} = \frac{2 \times m \times g}{P_{Luft} \times A \times C_w} \rightarrow m^2 = \frac{A^2 \times E' \times P_{Luft} \times C_w}{g},$$

wherein $C_w$ is the drag coefficient of the projectile in the air, and $P_{Luft}$ is the air pressure.

With the aid of a software program (e.g., PRODAS from the company Arrow Tech), the mass of the non-lethal projectile can be determined from these values. For this purpose, data or various tables for different calibers are stored in a computer, for example, for a 9 mm parabellum. Furthermore, $C_w$ values are stored in the ultrasound, and the volume sizes for projectiles.

Depending on the value of the selected average kinetic energy, e.g., E'=0.01 J/mm$^2$, the mass of the projectile can then be determined. The software can also identify the length of the gun barrel, the necessary gas pressure and the desired muzzle velocity. At least these values can be estimated.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A system for the protection of an infrastructure and for preventing a threat approaching the infrastructure, the system comprising:

at least one effector; and a command center having a fire control for the at least one effector, wherein upon detection of a threat, the at least one effector dispenses a non-lethal countermeasure that damages the threat and/or causes the threat to crash, and wherein the at least one effector includes non-lethal projectiles therein and the non-lethal countermeasure is a firing of the non-lethal projectiles, and wherein the non-lethal projectiles are plastic projectiles.

2. The system according to claim 1, further comprising a plurality of the at least one effector.

3. The system according to claim 1, wherein a visual and target tracker and at least one directing and/or actuating drive is assigned to the at least one effector.

4. The system according to claim 3, wherein at least one modular platform for receiving the at least one effector or a plurality of the at least one effector is included, and wherein the at least one modular platform is also used for receiving the visual and target tracker.

5. The system according to claim 1, wherein a monitoring sensor system having at least one sensor is included.

6. The system according to claim 1, wherein the system is adapted to be installed in/on various infrastructures and removed therefrom and adapted to be used in a mobile mode.

7. A system for the protection of an infrastructure and for preventing a threat approaching the infrastructure, the system comprising:

at least one effector; and a command center having a fire control for the at least one effector, wherein upon detection of a threat, the at least one effector dispenses a non-lethal countermeasure that damages the threat and/or causes the threat to crash, wherein the at least one effector includes non-lethal projectiles therein and the non-lethal countermeasure is a firing of the non-lethal projectiles, wherein a visual and target tracker and at least one directing and/or actuating drive is assigned to the at least one effector, wherein at least one modular platform for receiving the at least one effector or a plurality of the at least one effector is included, and wherein the at least one modular platform is also used for receiving the visual and target tracker, and wherein the at least one modular platform has a sensor, which detects a spatial position of the at least one effector or the plurality of the at least one effector.

8. The system according to claim 1, wherein the non-lethal projectiles have a kinetic energy $E' \leq 0.1\ J/mm^2$ upon reaching a maximum firing distance.

9. A system for the protection of an infrastructure and for preventing a threat approaching the infrastructure, the system comprising:

at least one effector; and a command center having a fire control for the at least one effector, wherein upon detection of a threat, the at least one effector dispenses a non-lethal countermeasure that damages the threat and/or causes the threat to crash, wherein the at least one effector includes non-lethal projectiles therein and the non-lethal countermeasure is a firing of the non-lethal projectiles, and wherein the at least one effector is a multi-barrel weapon with a high firing rate.

10. The system according to claim 1, wherein non-lethal projectiles that do not hit the threat reach a maximum flight time to break down the kinetic energy to $E' \leq 0.1\ J/mm^2$.

11. The system according to claim 1, wherein the non-lethal projectiles are plastic bullets or plastic missiles.

* * * * *